US008478183B2

(12) United States Patent
Minbu

(10) Patent No.: US 8,478,183 B2
(45) Date of Patent: Jul. 2, 2013

(54) IMAGE FORMING APPARATUS

(75) Inventor: Ryuuichi Minbu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 501 days.

(21) Appl. No.: 12/585,182

(22) Filed: Sep. 8, 2009

(65) Prior Publication Data

US 2010/0061741 A1 Mar. 11, 2010

(30) Foreign Application Priority Data

Sep. 8, 2008 (JP) ..... 2008-229628
Jul. 13, 2009 (JP) ..... 2009-164434

(51) Int. Cl.
*G03G 15/00* (2006.01)
*G03G 15/20* (2006.01)
*B65H 5/02* (2006.01)

(52) U.S. Cl.
USPC ..... 399/400; 399/397

(58) Field of Classification Search
USPC ..... 399/397, 400
See application file for complete search history.

(56) References Cited

U.S. PATENT DOCUMENTS

| | | | | |
|---|---|---|---|---|
| 6,108,514 | A * | 8/2000 | Nakayama et al. | 399/400 |
| 6,347,196 | B1 * | 2/2002 | Kawabata et al. | 399/16 |
| 6,661,989 | B2 * | 12/2003 | Pitts et al. | 399/322 |
| 7,010,260 | B2 * | 3/2006 | Behnke et al. | 399/401 |
| 2008/0317532 | A1 * | 12/2008 | Ehara et al. | 399/400 |

FOREIGN PATENT DOCUMENTS

| | | | |
|---|---|---|---|
| JP | 01122847 | A * | 5/1989 |
| JP | 04166969 | A * | 6/1992 |
| JP | 11255366 | A * | 9/1999 |
| JP | 2000352850 | A * | 12/2000 |
| JP | 2001-240268 | | 9/2001 |
| JP | 2001240268 | A * | 9/2001 |
| JP | 2002-002997 | | 1/2002 |
| JP | 2002002997 | A * | 1/2002 |
| JP | 2003337491 | A * | 11/2003 |
| JP | 2005091562 | A * | 4/2005 |
| JP | 2006285292 | A * | 10/2006 |
| JP | 2008152051 | A * | 7/2008 |
| JP | 2008197587 | A * | 8/2008 |

OTHER PUBLICATIONS

Machine Translation of JP 2002002997 A, JPO, Feb. 1, 2012.*

* cited by examiner

*Primary Examiner* — Matthew G Marini
*Assistant Examiner* — Nguyen Q Ha
(74) *Attorney, Agent, or Firm* — Harness, Dickey & Pierce, P.L.C.

(57) ABSTRACT

A transferring unit transfers a toner image from an image carrier to a recording medium. A fixing unit fixes the toner image transferred onto the recording medium. A conveying unit conveys the recording medium from the transferring unit to the fixing unit along a conveyance surface. A guiding member receives the recording medium from the conveying unit and guides the recording medium to a fixing nip of the fixing unit along a guiding surface. An angle changing unit changes an angle between the conveyance surface and the guiding surface according to the type of the recording medium.

15 Claims, 6 Drawing Sheets

IMAGE FORMING APPARATUS

CROSS-REFERENCE TO RELATED APPLICATIONS

The present application claims priority to and incorporates by reference the entire contents of Japanese Patent Application No. 2008-229628 filed in Japan on Sep. 8, 2008 and Japanese Patent Application No. 2009-164434 filed in Japan on Jul. 13, 2009.

BACKGROUND OF THE INVENTION

1. Field of the Invention

The present invention relates to an image forming apparatus such as a printer, a facsimile, and a copier.

2. Description of the Related Art

The conventional image forming apparatus shown in FIG. 7A includes a transferring unit 150 that transfers a toner image onto a surface of a recording sheet P; a fixing unit 180 that fixes the toner image to the recording sheet P; and a conveying unit 175 that conveys the recording sheet P from the transferring unit 150 to the fixing unit 180. The recording sheet P is a recording medium such as a paper sheet. The conveying unit 175 includes two rollers 177 and 178 and a conveying belt 176 that is supported by the rollers 177 and 178. The conveying unit 175 conveys the recording sheet P with the recording sheet P placed on an upper surface of the conveying belt 176 (hereinafter, "conveyance surface") so that the recording sheet P comes into contact with a fixing-unit-entrance guiding plate 183 at a fixed angle. The fixing-unit-entrance guiding plate 183 is arranged in front of a nip in the fixing unit 180 (hereinafter, "fixing nip"). The recording sheet P is then conveyed to the fixing unit 180, guided by the fixing-unit-entrance guiding plate 183. Because the height and angle of the conventional fixing-unit-entrance guiding plate 183 is fixed, it is difficult to maintain high smoothness when conveying various types of irregular recording sheets, such as oversize sheets having margins with crop marks, and postcards, thin sheets, and thick sheets.

If the recording sheet P is a large sheet having a length longer than the distance between the nip in the transferring unit 150 (hereinafter, "transferring nip") and the fixing nip, when a leading edge of the recording sheet P enters the fixing nip with the recording sheet P being flat, a vibration is likely to occur at the transferring nip and, therefore, a distorted image is likely to be formed. To solve the problem, the conveyance surface of the conveying unit 175 is arranged beneath an imaginary straight line drawn between the transferring nip and the fixing nip so that the impact that occurs when the leading edge enters the fixing nip cannot be transmitted to the transferring nip. In contrast, if the length of the recording sheet P is shorter than the distance between the transferring nip and the fixing nip, the recording sheet P is conveyed only by the force produced by the conveying unit 175. If the conveying unit 175 is arranged in the above-described manner such that the conveyance surface is beneath the imaginary straight line, the recording sheet P that is an extremely thick sheet may exit the transferring nip in a rigid manner and form a "bridge" between a transferring-unit-exit guiding plate 157 near the transferring nip and the fixing-unit-entrance guiding plate 183. In some cases, a paper jam occurs because there is no contact between the recording sheet P and the conveyance surface of the conveying belt 176 or because there is not enough force to convey the recording sheet P up to and along the fixing-unit-entrance guiding plate 183.

If the fixing-unit-entrance guiding plate 183 and the conveyance surface of the conveying belt 176 make a large angle, the recording sheet P is likely to be in contact with the conveying belt 176 and, therefore, the recording sheet P is easy to enter the fixing-unit-entrance guiding plate 183. Therefore, such paper jams are prevented. However, as shown in FIG. 7B, if the recording sheet P is a thin sheet with a curled leading edge, the recording sheet P is conveyed along the fixing-unit-entrance guiding plate 183 with the leading edge curved upward in noncontact with the fixing-unit-entrance guiding plate 183. The recording sheet P then enters the fixing nip with the leading edge being pointing away from the fixing nip. As a result, a crease is made in the recording sheet P.

The following image forming apparatuses are widely-known that can convey a thick small sheet, such as a postcard, at a high smoothness of conveyance while suppressing vibration of the recording sheet at the transferring nip.

FIG. 10 is an enlarged schematic diagram of a conveying unit 500 and relevant parts included in an image forming apparatus disclosed in Japanese Patent Application Laid-open No. 2001-240268. The conveying unit 500 includes a first unit and a second unit. The first unit includes a first conveying belt 501 that endlessly rotates in a counterclockwise direction in the plane of paper of FIG. 10 and a first roller 502 and a second roller 503 that support the first conveying belt 501. The second unit includes a second conveying belt 504 that endlessly rotates in the counterclockwise direction and a third roller 505 and a forth roller 506 that support the second conveying belt 504. The second roller 503 and the third roller 505 are arranged coaxially, surrounding a single shaft. They can run idle. The first unit swings about the shaft with the shaft being the fulcrum. The conveying unit 500 is designed so that both sections can swing about the fulcrum at or close to the center of the unit in the sheet conveying direction. A guiding plate 507 is fixed to the first unit. The guiding plate 507 guides the recording sheet to a nip between a heat roller 508 and a pressure roller 509 that are included in the fixing unit. The guiding plate 507 swings together with the first unit. If the recording sheet P is a regular sheet, the conveying unit 500 receives the recording sheet P in such a manner that the first unit and the second unit are arranged substantially in a straight line as shown in FIG. 10 and conveys the recording sheet P that is guided by the guiding plate 507 to the entrance of the fixing nip.

FIG. 11 is a schematic diagram that depicts an arrangement of the conveying unit 500 when a large thick sheet is used as the recording sheet P. If the conveying unit 500 receives the large thick sheet that has a length longer than the distance between the transferring nip (not shown in FIG. 11) and the fixing nip, a left side of the first unit swings up. The thick sheet is then guided toward a position on the surface of the heat roller 508 that is located in front of the fixing nip. After coming into contact with the heat roller 508, the leading edge of the thick sheet bends and then enters the fixing nip. Because of the bending at the leading edge, the force that is applied to the leading edge using the fixing nip to convey the thick sheet is not significantly transmitted to the transferring nip between which the trailing-edge side of the thick sheet is inserted. As a result, the formation of distorted images at the transferring nip is prevented.

FIG. 12 is a schematic diagram that depicts an arrangement of the conveying unit 500 when a postcard is used as the recording sheet P. When the conveying unit 500 receives the postcard, the left side of the first unit swings down and the trailing edge of the postcard abuts against the surface of the first conveying belt 501. Because the trailing edge of the postcard abuts against the surface of the first conveying belt 501, the smoothness in conveying of postcards is improved.

FIG. 13 is an enlarged schematic diagram of a conveying unit 600 and relevant parts according to an image forming apparatus disclosed in Japanese Patent Application Laid-open No. 2002-2997. The conveying unit 600 is designed so that both sections can swing about a fulcrum at or close to the center of the unit in the same manner as the conveying unit 500 is designed. In contrast to the conveying unit 500, a guiding plate 607 of the conveying unit 600 is arranged near the fixing nip in a fixed manner.

FIG. 14 is a schematic diagram that depicts an arrangement of the conveying unit 600 when a large thick sheet is used as the recording sheet P. If the conveying unit 600 receives the large thick sheet that has a length longer than the distance between the transferring nip and the fixing nip, the center of the conveying unit 600 lowers as shown in FIG. 14 by swinging of the first unit, so that the center of the thick sheet that is placed over the two conveying belts bends at a steep angle. Because of this bending, the force that is applied to the leading edge using the fixing nip to convey the thick sheet is not significantly transmitted to the transferring nip between which the trailing-edge side of the thick sheet is inserted. As a result, the formation of distorted images at the transferring nip is prevented.

FIG. 15 is a schematic diagram that depicts an arrangement of the conveying unit 600 when a postcard is used as the recording sheet P. If the conveying unit 600 receives the postcard, the left side of the first unit swings down and the trailing edge of the postcard abuts against the surface of the first conveying belt 501 in the same manner as in the conveying unit 500. Because the trailing edge of the postcard abuts against the surface of the first conveying belt 501, the smoothness in conveying of postcards is improved.

In the image forming apparatuses disclosed in Japanese Patent Application Laid-open No. 2001-240268 and Japanese Patent Application Laid-open No. 2002-2997, each of the conveying units 500 and 600 is designed so that both sections can swing about the fulcrum at or close to the center of the unit. This design, in turn, increases the number of parts and manufacturing costs.

Furthermore, the image forming apparatus disclosed in Japanese Patent Application Laid-open No. 2001-240268 may form a snake-like line when a large thick sheet is used as the recording sheet P. When the thick sheet comes into contact with the heat roller 508 at the position that is located in front of the fixing nip (hereinafter, "contact position"), as shown in FIG. 11, toner unfixed to the thick sheet may be rubbed against the surface of the heat roller 508 along the path from the contact position to the fixing nip. This creates a snake-like line running in the sheet conveying direction.

In the image forming apparatus disclosed in Japanese Patent Application Laid-open No. 2002-2997, a paper jam may occur when a postcard is used as the recording sheet P. To obtain a force large enough to convey the postcard from the first conveying belt as definitely as possible, the first conveying belt 501 is preferably sloped as steep as possible with the left side down. However, as the slope of the first conveying belt 501 gets steeper, the angle between the postcard and surface of the guiding plate 507 decreases. If the angle is too small, the leading edge of the postcard fails to turn the corner and the trailing edge of the postcard slips against the first conveying belt 501. As a result, a paper jam occurs.

In the image forming apparatus disclosed in Japanese Patent Application Laid-open No. 2002-2997, if a thin sheet, such as a regular sheet or a thin sheet, that has a the slightly curled leading edge, as shown in FIG. 7B, is used as the recording sheet P, there is possibility that the recording sheet will be folded inwardly or a crease is made at the leading edge. As shown in FIG. 7B, when the regular sheet or the thin sheet that has a slightly curled leading edge is conveyed to the fixing unit along the gentle slope, the fixing nip is likely to receive the recording sheet with the backside of the leading edge upward; therefore, a fold or a crease is likely to be made. In contrast, when the regular sheet or the thin sheet that has a slightly curled leading edge is conveyed to the fixing unit along a steep slope, the curled leading edge comes into contact with the contact position of the roller that is located in front of the entrance of the fixing nip and then turns its moving direction toward the fixing nip. The recording sheet moves from the contact position to the fixing nip with the curled leading edge abutting against the surface of the roller. This means that, if regular sheets and thin sheets, which are likely to have slightly curled leading edges, are used as the recording sheet P, it is preferable to set the fixing-unit-entrance guiding plate 183 to a steep slope. However, in the image forming apparatus disclosed in Japanese Patent Application Laid-open No. 2002-2997 shown in FIGS. 13 to 15, the angle of the guiding plate 507 is fixed even when a recording sheet having a different thickness is conveyed. If the fixed angle is not appropriate for the recording sheet, there is possibility of folding and creasing at the recording sheet's leading edge.

SUMMARY OF THE INVENTION

It is an object of the present invention to at least partially solve the problems in the conventional technology.

According to one aspect of the present invention, there is provided an image forming apparatus including: a transferring unit that transfers a toner image from an image carrier to a recording medium; a fixing unit that fixes the toner image transferred onto the recording medium; a conveying unit that conveys the recording medium from the transferring unit to the fixing unit along a conveyance surface; a guiding member that receives the recording medium from the conveying unit and guides the recording medium to a fixing nip of the fixing unit along a guiding surface; and an angle changing unit that changes an angle between the conveyance surface and the guiding surface in a sheet conveying direction according to a type of the recording medium. In a case where the recording medium is a thick with a length such that a trailing edge of the recording medium passes through the transferring unit when a leading edge of the recording medium comes into contact with the guiding surface, the angle changing unit changes the angle to a first angle that is larger than a second angle to be set when the recording medium is a medium thinner than the thick medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
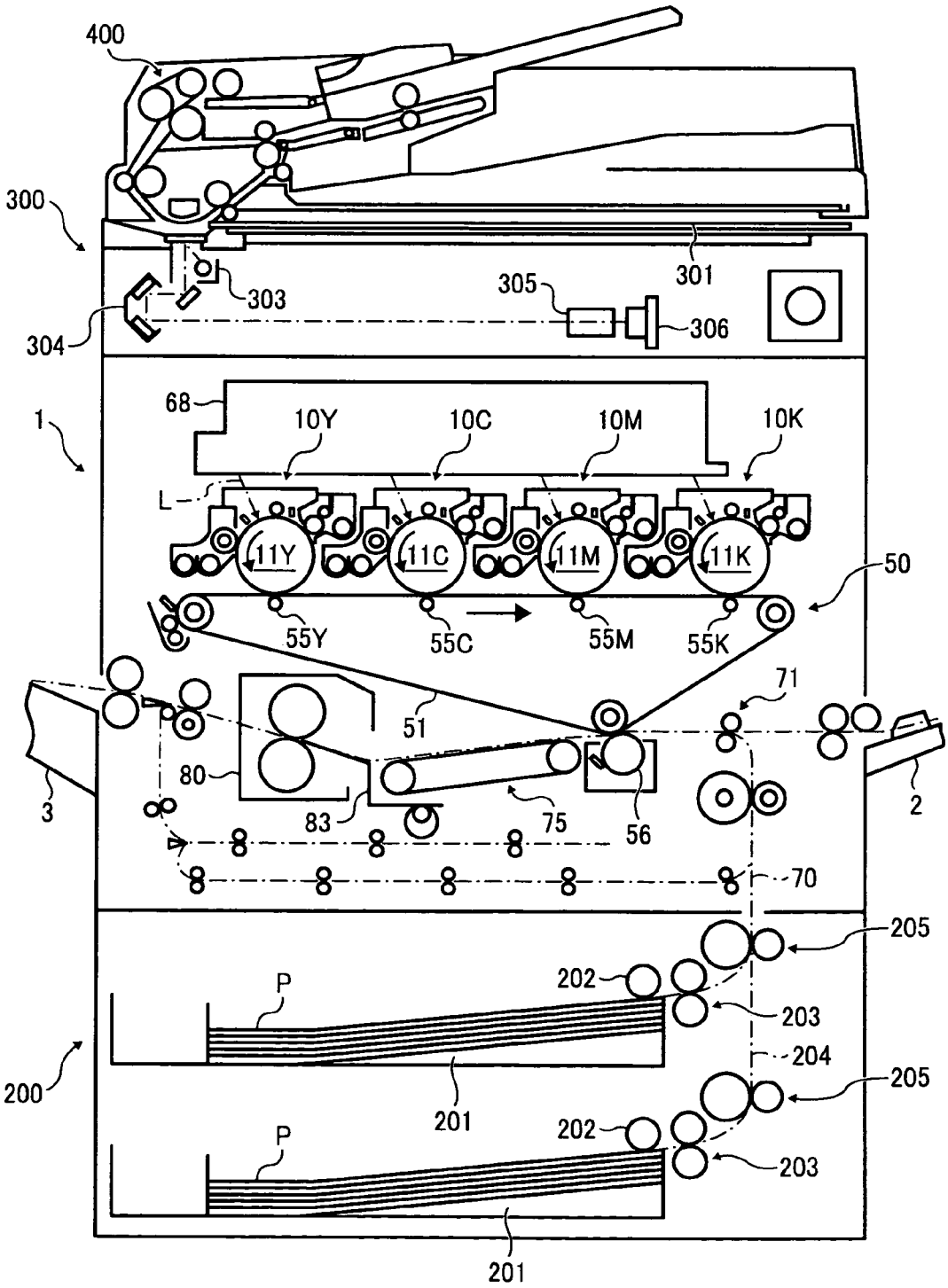
FIG. 1 is a schematic side view of an internal configuration of a copier according to an embodiment of the present invention.

Exemplary embodiments of the present invention are described in detail below with reference to the accompanying drawings. An electrophotographic copier is used as an image forming apparatus to explain the following embodiments. FIG. 1 is a schematic side view of an internal configuration of a copier according to an embodiment of the present invention. The copier includes a printing device 1 that forms an image on the recording sheet P; a paper-feed device 200 that feeds the recording sheet P toward the printing device 1; a scanner 300 that scans an image from an original (not shown), and an automatic document feeder (ADF) 400 that automatically feeds the original toward the scanner 300.

The scanner 300 includes a first carrier 303 and a second carrier 304. The first carrier 303 includes a mirror and a light source that illuminates the original. The second carrier 304 includes a plurality of reflecting mirrors. The first carrier 303 and the second carrier 304 move back and forth to scan the original that is placed on an exposure glass 301. The second carrier 304 transmits a scanning light. The scanning light passes through an imaging lens 305 and then focuses onto an imaging surface of a scanning sensor 306. The scanning sensor 306 receives the scanning light as an image signal.

A bypass tray 2 and a discharge tray 3 are attached to side faces of a housing of the printing device 1. The bypass tray 2 is used to feed a user-specified sheet into the housing as the recording sheet P. The user manually places the sheet on the bypass tray 2. After an image is formed on the recording sheet P, the recording sheet P is discharged out of the housing and stacked in the discharge tray 3.

Figure 2:
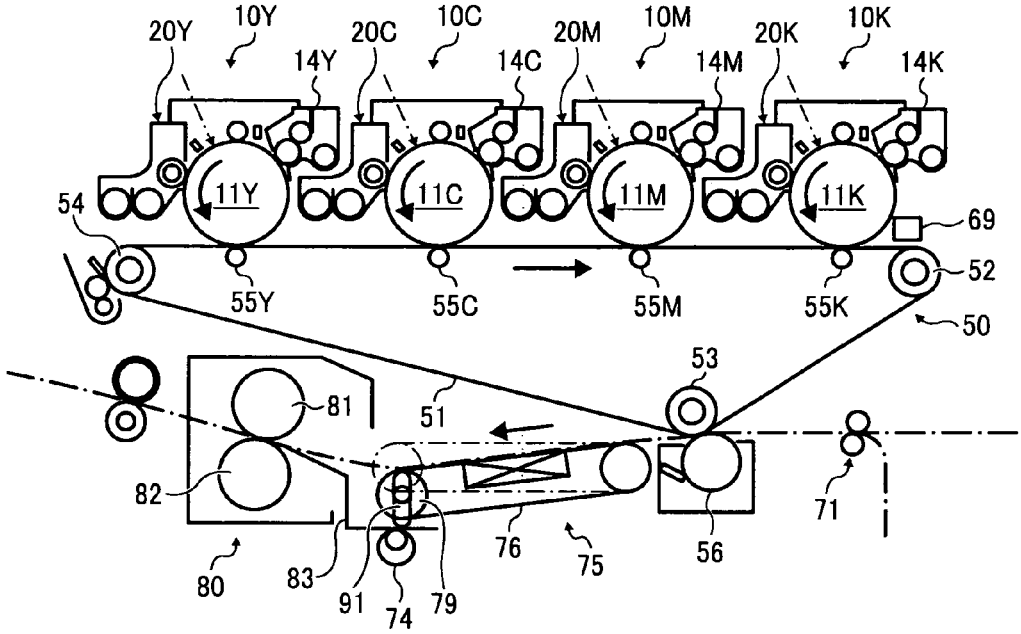
FIG. 2 is a schematic side view of an internal configuration of a printing device shown in FIG. 1.

FIG. 2 is a schematic side view of an internal configuration of the printing device 1. There is a transferring unit 50 inside the housing of the printing device 1. The transferring unit 50 includes an intermediate transfer belt 51 and a plurality of rollers 52, 53, 54, 55Y, 55C, 55M, 55K that supports the intermediate transfer belt 51. The intermediate transfer belt 51 rotates endlessly in the clockwise direction in the plane of paper of FIG. 2 by rotation of the roller 52. The roller 52 is a driving roller that is rotated by a driving unit (not shown) in the clockwise direction. The roller 53 is a secondary-transfer backup roller. The roller 54 is a driven roller. The rollers 55Y, 55C, 55M, 55K are primary-transfer rollers. The symbols Y, C, M, and K appended to reference numbers mean colors of toner: Y is yellow, C is cyan, M is magenta, and K is black. A component having a reference number appended with Y, for example, is related to formation of a yellow toner image.

The intermediate transfer belt 51 runs along an inverted triangle with the apex pointing downward. The corners of the triangle are made by the driving roller 52, the secondary-transfer backup roller 53, and the driven roller 54. The base side of the triangle runs parallel to the horizontal direction. Four process units 10Y, 10C, 10M, and 10K are arranged in the horizontal direction above the base side.

Referring back to FIG. 1, an optical writing unit 68 is arranged above the process units 10Y, 10C, 10M, and 10K. The optical writing unit 68 controls four laser diodes (LDs) (not shown) using a laser control unit (not shown) so that the LDs emit four rays of writing light L based on image data that is acquired from the original by the scanner 300. The optical writing unit 68 scans drum-shaped photosensitive elements 11Y, 11C, 11M, and 11K in a dark environment with the writing light L so that a latent image for the corresponding color is formed on each of the photosensitive elements 11Y, 11C, 11M, and 11K. The photosensitive elements 11Y, 11C, 11M, and 11K are latent-image carriers included in the process units 10Y, 10C, 10M, and 10K, respectively.

The optical writing unit 68 performs optical scanning by deflecting laser light that is emitted from the LDs by a polygon mirror (not shown), reflecting the deflected laser light by a plurality of reflecting mirrors (not shown), and causing the deflected laser light to pass through an optical lens. It is allowable to use a writing unit that performs optical scanning using a light-emitting diode (LED) instead of the optical writing unit 68.

Figure 3:
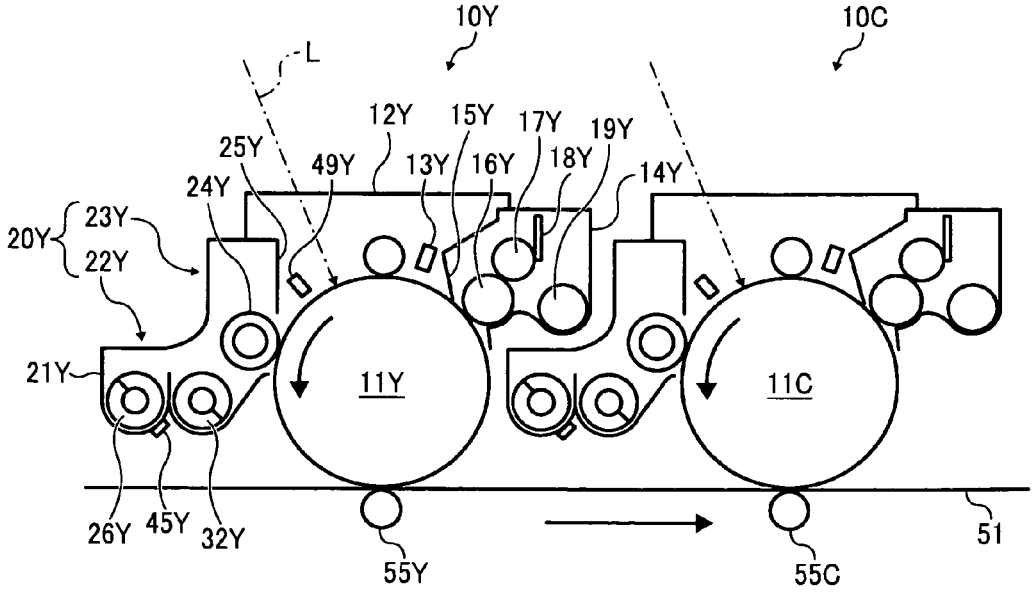
FIG. 3 is a schematic diagram of process units for yellow and cyan shown in FIG. 2.

FIG. 3 is a schematic diagram of the process units 10Y and 10C. The process unit 10Y includes the drum-shaped photosensitive element 11Y and other units that are arranged around the photosensitive element 11Y. The other units include a charging member 12Y, a neutralizing device 13Y, a drum cleaning device 14Y, a developing device 20Y, and a potential sensor 49Y. All of the above-described units are arranged inside a single casing so that they can be attached/detached to/from the printing device 1 as a unit.

The charging member 12Y is a roller that is supported rotatably by a bearing (not shown), being in contact with the photosensitive element 11Y. The charging member 12Y is charged with a charging bias by a bias applying unit (not shown). After that, the charging member 12Y rotates, being in contact with the photosensitive element 11Y, thereby evenly charging the surface of the photosensitive element 11Y so that the polarity of the photosensitive element 11Y is, for example, the same as that of yellow toner.

Alternatively, a contactless charging member, such as a scorotron charger, can be used to evenly charge the photosensitive element 11Y instead of the contact-type charging member 12Y.

The developing device 20Y includes a casing 21Y that houses yellow developer (not shown) containing magnetic carrier and nonmagnetic yellow toner. The developing device 20Y further includes a developer conveying device 22Y and a developing unit 23Y. The developing unit 23Y includes a developing sleeve 24Y that functions as a developer carrier. A surface of the developing unit 23Y is rotated endlessly by a driving unit (not shown). A part of the surface of the developing sleeve 24Y is outside of the casing 21Y through an opening. The part of the developing unit 23Y is opposed to the photosensitive element 11Y via a predetermined gap, thereby forming a developing area.

The developing sleeve 24Y is a hollow pipe-shaped roller made of a nonmagnetic material. A plurality of magnetic rollers having multiple magnetic poles (not shown) is arranged inside the developing sleeve 24Y in the circumferential direction. The magnetic rollers are at fixed positions even when the developing sleeve 24Y rotates. The developing sleeve 24Y attracts the yellow developer from the developer conveying device 22Y by a magnetic force generated by the magnetic rollers and rotates with the yellow developer attached on the surface. The attached yellow developer is conveyed toward the developing area as the developing sleeve 24Y rotates. Before entering the developing area, the attached yellow developer enters a doctor gap that is formed between the surface of the developing sleeve 24Y and a tip of a doctor blade 25Y. The yellow developer on the developing sleeve 24Y is shaped into a layer having a thickness substantially equal to the doctor gap. The yellow developer is further conveyed and then raised near the developing area by the magnetic force caused by a developing magnetic pole (not shown) of the magnetic rollers, thereby forming a magnetic brush on the developing sleeve 24Y.

The developing sleeve 24Y is charged by a bias applying unit (not shown) with a charging bias having the polarity, for example, the same as that of the charged toner. Therefore, in the developing area, a first potential exerts between the surface of the developing sleeve 24Y and a no-image part of the photosensitive element 11Y (background part that is charged evenly) that electrostatically moves the yellow toner from the background part to the developing sleeve 24Y, while a second potential exerts between the surface of the developing sleeve 24Y and a latent-image part of the photosensitive element 11Y that electrostatically moves the yell toner from the developing sleeve 24Y to the latent-image part. The yellow toner moves from the yellow developer to only the electrostatic latent image by the exertions of the first potential and the second potential. As a result, the latent image on the photosensitive element 11Y is developed into the yellow toner image.

After passed through the developing area as the developing sleeve 24Y further rotates, the remained yellow developer moves back from the developing sleeve 24Y to the developer conveying device 22Y by an exertion of a repulsive magnetic field between the repulsive poles of the magnetic rollers.

The developer conveying device 22Y includes a first screw 26Y, a second screw 32Y, a partition between the first screw 26Y and the second screw 32Y, and a toner-density detecting sensor 45Y that uses magnetic permeability to detect toner density. The partition, more particularly, separates a first toner aisle that includes the first screw 26Y and a second toner aisle that includes the second screw 32Y. The first toner aisle and the second toner aisle, however, are not completely separated from each other but connected to each other through openings (not shown) that are arranged at ends in the axial direction of the first screw 26Y and the second screw 32Y. The first screw 26Y and the second screw 32Y agitate the yellow toner. Each of the first screw 26Y and the second screw 32Y includes a rotation shaft that is supported rotatably by bearings (not shown) at its both ends and a helical fin attached to the rotation shaft. The first screw 26Y and the second screw 32Y convey the yellow developer in the axial direction using the helical fins as they are rotated by a driving unit (not shown).

Inside the first toner aisle, where there is the first screw 26Y, the toner is conveyed in a direction perpendicular to the plane of paper of FIG. 3 from the front side to the rear side as the first screw 26Y rotates. When the toner is conveyed to near the end of the casing 21Y at the rear side, the toner is conveyed to the second toner aisle, passed through the opening formed on the partition. There is the above-described developing unit 23Y above the second toner aisle that includes the second screw 32Y. There is no partition between an upper side of the second toner aisle and a lower side of the developing unit 23Y. The developing sleeve 24Y is arranged obliquely upside of the second screw 32Y, parallel to the second screw 32Y. Inside the second toner aisle, the yellow developer is conveyed in the direction perpendicular to the plane of paper of FIG. 3 from the rear side to the front side as the second screw 32Y rotates. In the course of the toner flow through the second toner aisle, a part of the yellow developer near around the second screw 32Y moves up to the developing sleeve 24Y, and the yellow developer that is remained after the development returns from the developing sleeve 24Y to the second toner aisle. When the yellow developer is conveyed to near the end of the second toner aisle at the front side, the yellow developer is conveyed to the first toner aisle, passed through the opening formed on the partition.

The toner-density detecting sensor 45Y, which uses magnetic permeability to detect toner density, is fixed to a lower-side wall of the first toner aisle. The toner-density detecting sensor 45Y detects the toner density of the yellow developer that is being conveyed thereabove by the rotation of the first screw 26Y and outputs a voltage corresponding to a result of detection. A control unit (not shown) causes, based on the voltage received from the toner-density detecting sensor 45Y, a yellow-toner supplying unit to supply an appropriate amount of the yellow toner to the first toner aisle if required. In this manner, if the toner density of the yellow developer decreases due to development, the control unit increases the toner density.

The yellow toner image formed on the photosensitive element 11Y is primary-transferred onto the intermediate transfer belt 51 at a primary-transfer nip for yellow. Residual toner is remained on the surface of the intermediate transfer belt 51 after the primary transfer.

The drum cleaning device 14Y includes a cleaning blade 15Y made of, for example, polyurethane rubber. The cleaning blade 15Y is a cantilever blade. A free end of the cleaning blade 15Y is in contact with the surface of the photosensitive element 11Y. The drum cleaning device 14Y includes a brush roller 16Y. The brush roller 16Y includes a rotation shaft that is rotated by a driving unit (not shown) and countless conductive treads rising from the circumference of the rotation shaft. The tips of the treads are in contact with the photosensitive element 11Y. The drum cleaning device 14Y removes the residual toner from the surface of the photosensitive element 11Y using the cleaning blade 15Y and the brush roller 16Y. The brush roller 16Y is charged with a cleaning bias via a metallic electric-field roller 17Y that is in contact with the brush roller 16Y. The electric-field roller 17Y is in contact with a tip of a scraper 18Y. After being removed from the photosensitive element 11Y using the cleaning blade 15Y and the brush roller 16Y, the residual toner is moved to the brush roller 16Y and then to the electric-field roller 17Y. After that, the residual toner is removed from the electric-field roller 17Y by the scraper 18Y. The removed residual toner then falls down to a collecting screw 19Y. The residual toner is conveyed outside of the casing as the collecting screw 19Y rotates. Thereafter, the residual toner is returned back to the developer conveying device 22Y via a toner recycle unit (not shown).

After the residual toner is removed from the surface of the photosensitive element 11Y by the drum cleaning device 14Y, the photosensitive element 11Y is neutralized by the neutralizing device 13Y that includes a neutralizing lamp. After that, the photosensitive element 11Y is evenly charged again by the charging member 12Y.

The configuration of the process unit 10Y is described above. The configuration of the process units 10C, 10M, and 10K are the same as that of the process unit 10Y except the color of toner. Therefore, the same description is not repeated.

Referring back to FIG. 2, each of the rotating photosensitive elements 11Y, 11C, 11M, and 11K of the process units 10Y, 10C, 10M, and 10K makes the primary-transfer nip with the upper surface of the intermediate transfer belt 51 that endlessly rotates in the clockwise direction. Each of the primary-transfer rollers 55Y, 55C, 55M, and 55K is located at the corresponding primary transfer nip, being in contact with an inner surface of the intermediate transfer belt 51. The primary-transfer rollers 55Y, 55C, 55M, and 55K are charged by a bias applying unit (not shown) with a primary-transfer bias having the polarity opposite to the polarity of the charged toner. The primary-transfer bias produces primary-transfer electric fields at the primary-transfer nips to electrostatically move toner from the photosensitive elements 11Y, 11C, 11M, and 11K to the intermediate transfer belt 51. Upon being conveyed to the corresponding primary-transfer nip, each of the toner images of yellow, cyan, magenta, and black is primary-transferred from the corresponding photosensitive element 11Y, 11C, 11M, or 11K to the intermediate transfer belt 51 in a superimposed manner by the exertion of the primary-transfer electric field and the nip pressure. In this manner, a 4-color superimposed toner image (hereinafter, "4-color toner image") is formed on the outer surface of the intermediate transfer belt 51. Some other members, such as conductive brushes or contactless corona chargers, can be charged with the primary-transfer bias instead of the primary-transfer rollers 55Y, 55C, 55M, and 55K.

An optical sensor unit 69 is arranged right in the plane of paper of FIG. 2 of the process unit 10K, spaced a predetermined gap away from the outer surface of the intermediate transfer belt 51. The optical sensor unit 69 detects marks (not shown) arranged along a belt-width side spaced at predetermined pitches in the circumferential direction of the intermediate transfer belt 51. The moving speed of the intermediate transfer belt 51 can be calculated using a pitch between time points when any two of the marks are detected.

A secondary-transfer roller 56 is arranged at the lower side, being in contact with the intermediate transfer belt 51. The secondary-transfer roller 56 is rotated in the counter-clockwise direction by a driving unit (not shown). The secondary-transfer roller 56 makes the secondary-transfer nip with the outer surface of the intermediate transfer belt 51. The secondary-transfer backup roller 53 supports the intermediate transfer belt 51 at the secondary-transfer nip, being in contact with the inner surface. The secondary-transfer roller 56 is charged by a secondary-transfer power supply (not shown) with a secondary-transfer bias having the polarity the same as the polarity of the charged toner. In contrast, the secondary-transfer roller 56, which makes the secondary-transfer nip being in contact with the outer surface of the intermediate transfer belt 51, is grounded. This configuration produces a secondary-transfer electric field between the secondary-transfer backup roller 53 and the secondary-transfer roller 56. The 4-color toner image that is formed on the outer surface of the intermediate transfer belt 51 is conveyed to the secondary-transfer nip as the intermediate transfer belt 51 rotates.

Referring back to FIG. 1, the paper-feed device 200 includes a plurality of paper cassettes 201 that accommodates the recording sheet P. Each of the paper cassettes 201 is provided with a paper-feed roller 202 that feeds the recording sheet P from the paper cassette 201; a pair of separation rollers 203 that receives the recording sheet P from the paper-feed roller 202 and separates, if the recording sheet P is two or more sheets, one by one; a pair of conveyer rollers 205 that conveys the separated recording sheet P along a paper-feed path 204. The paper-feed device 200 is arranged immediately below the printing device 1 as shown in FIG. 1. The paper-feed path 204 of the paper-feed device 200 is connected to a paper-feed path 70 of the printing device 1. The recording sheet P is fed from the paper cassette 201 of the paper-feed device 200, and then conveyed to the paper-feed path 70 of the printing device 1 via the paper-feed path 204.

A pair of registration rollers 71 is arranged near an end of the paper-feed path 70 of the printing device 1. The registration rollers 71 convey the recording sheet P to the secondary-transfer nip at proper timing so that the 4-color toner image can be transferred to the recording sheet P properly. The 4-color toner image is then secondary-transferred from the intermediate transfer belt 51 to the recording sheet P at the secondary-transfer nip by the exertion of the primary-transfer electric field and the nip pressure. A full-color image is thus formed with addition of white from the recording sheet P. The recording sheet P on which the full-color image is formed is then passed through the secondary-transfer nip and further conveyed away from the intermediate transfer belt 51.

The recording sheet P, after passed through the secondary-transfer nip, is conveyed to a later-described conveying unit 75 along a secondary-transfer-exit guiding plate 57. The conveying unit 75 conveys the recording sheet P toward a fixing nip in a fixing unit 80 along a fixing-unit-entrance guiding plate 83. The fixing nip is made between a heat roller 81 that includes a heat source (not shown), such as a halogen lamp, and a pressure roller 82 that is in press-contact with the heat roller 81. When the recording sheet P is inserted to the fixing nip, the full-color image is fixed to the surface of the recording sheet P by the heat and pressure. After that, the recording sheet P is conveyed of the fixing unit 80.

Figure 4:
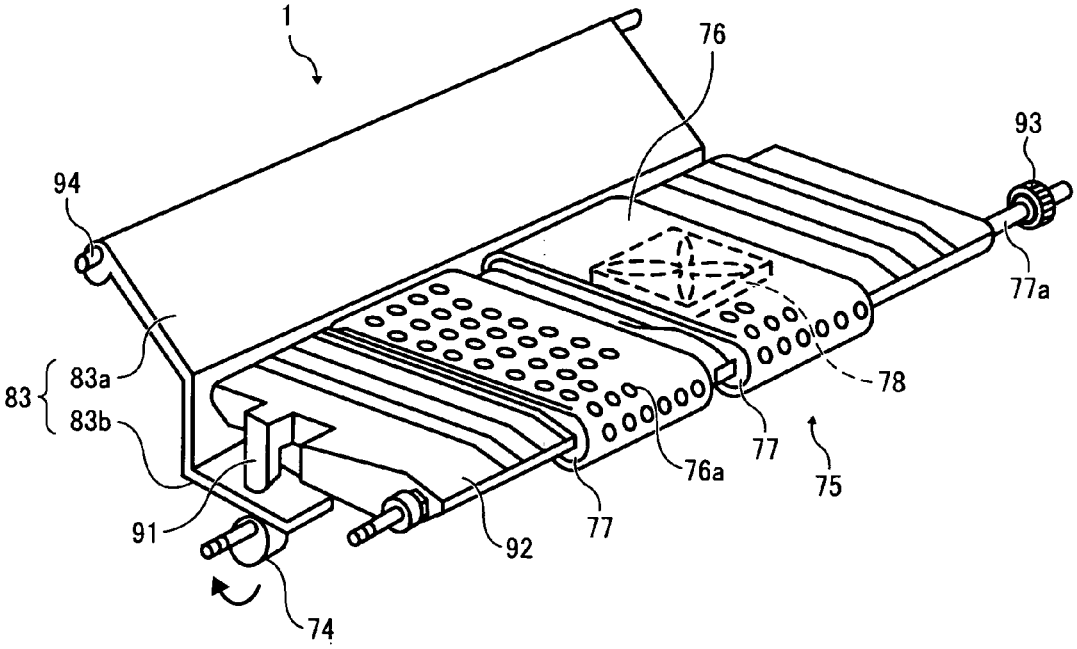
FIG. 4 is a perspective view of a conveying unit and a fixing-unit-entrance guiding plate shown in FIG. 2.

The conveying unit 75 and the fixing-unit-entrance guiding plate 83 are described in detail below. FIG. 4 is a perspective view of the conveying unit 75 and the fixing-unit-entrance guiding plate 83. The conveying unit 75 includes a driving roller 77 and a driven roller 79 (see FIGS. 5A and 5B), a conveying belt 76 that endlessly rotates in the counterclockwise direction in the plane of paper of FIG. 4, and a belt guiding member 92. The driving roller 77 and the driven roller 79 support the conveying belt 76. The belt guiding member 92 guides the conveying belt 76, being in contact with an inner surface of the conveying belt 76. The recording sheet P is conveyed, placed on an upper surface of the conveying belt 76 (hereinafter, "conveyance surface"). There is a sheet-suction fan 78 between the driving roller 77 and the driven roller 79. The conveying belt 76 has a plurality of pores 76*a*. The sheet-suction fan 78 generates airflow through the pores 76*a* so that the recording sheet P adheres to the conveying belt 76. With this configuration, the conveying unit 75 conveys the recording sheet P without fail. The fixing-unit-entrance guiding plate 83, which guides the recording sheet P in such a manner that the recording sheet P enters the fixing nip at a predetermined angle, is arranged near an end of the conveying unit 75 closer to the fixing nip (left side in the plane of paper of FIGS. 5A and 5B). The fixing-unit-entrance guiding plate 83 has a guiding surface 83*a* along which the recording sheet P is conveyed and a contact surface 83*b* that is a shape of letter L in the cross section. The guiding surface 83*a* and the contact surface 83*b* are continuous. An upper side of the contact surface 83*b* is in contact with a supporting member 91. A lower side of the contact surface 83*b* is in contact with an eccentric cam 74. The supporting member 91 is attached to an edge of the belt guiding member 92 without being behind the conveying belt 76. The eccentric cam 74 is rotated by a cam motor 450 (not shown).

In the configuration of the conveying unit 75 and the fixing-unit-entrance guiding plate 83, an angle θ between the conveyance surface of the conveying unit 75 and the guiding surface 83*a* is set appropriately by rotation of the eccentric cam 74 in a direction indicated by an arrow shown in FIG. 4. In the embodiment, the conveyance surface is a part of the entire surface of the conveying belt 76 where the recording sheet P is conveyed toward the fixing-unit-entrance guiding plate 83 in a direction in which the conveyance surface extends. More particularly, the conveyance surface is the part of the conveying belt 76 immediately upstream of the driven roller 79.

A driving-roller shaft 77*a* of the driving roller 77 is arranged at a side closer to the transferring unit 50 in the conveying unit 75 in a fixed manner. The driving-roller shaft 77*a* is rotated by force received from a main-body driving system (not shown) via a conveying-unit driving gear 93. The conveying unit 75 can swing about on the driving-roller shaft 77*a*. A slope of the conveyance surface is set depending on a position of the supporting member 91 of the belt guiding member 92 that is in contact with the contact surface 83*b* of the fixing-unit-entrance guiding plate 83. The fixing-unit-entrance guiding plate 83 can swing about on a pin 94 that is arranged near the fixing nip. The pin 94 is a shaft that supports the fixing-unit-entrance guiding plate 83. A slope of the guiding surface 83*a* is set depending on a rotational position of the eccentric cam 74. The position at which the fixing-unit-entrance guiding plate 83 is in contact with a cam surface of the eccentric cam 74 is set depending on the rotational position of the eccentric cam 74. With this configuration, the angle θ between the conveyance surface of the conveying unit 75 and the guiding surface 83*a* of the fixing-unit-entrance guiding plate 83 is set appropriately by setting both the slope of the conveying unit 75 and the slope of the fixing-unit-entrance guiding plate 83 in an associated manner.

More particularly, the angle θ between the conveyance surface of the conveying unit 75 and the guiding surface 83*a* of the fixing-unit-entrance guiding plate 83 is set in the following manner.

Figure 5A:
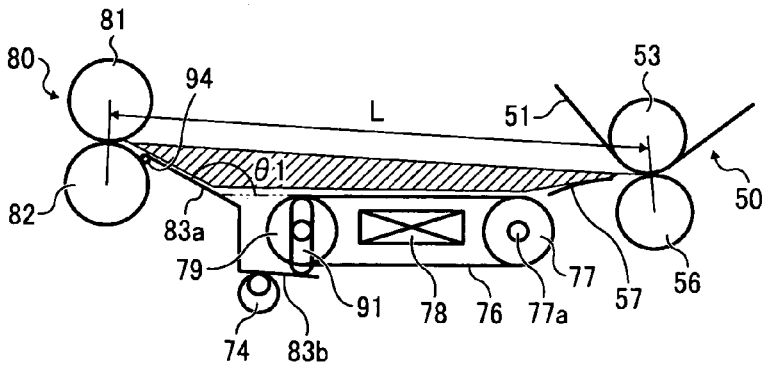
FIG. 5A is a schematic diagram of the conveying unit and the fixing-unit-entrance guiding plate when a mode A is selected.
Figure 5B:
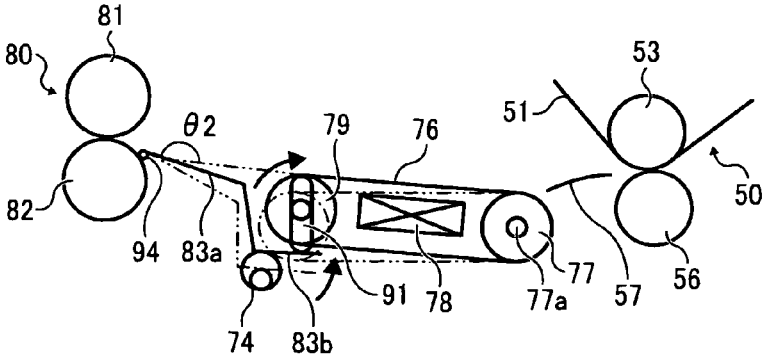
FIG. 5B is a schematic diagram of the conveying unit and the fixing-unit-entrance guiding plate when a mode B is selected.

FIG. 5A is a schematic diagram of the conveying unit 75 and the fixing-unit-entrance guiding plate 83 when a mode A is selected. FIG. 5B is a schematic diagram of the conveying unit 75 and the fixing-unit-entrance guiding plate 83 when a mode B is selected. The mode A is selected when the recording sheet P is a large sheet or a thin, small sheet having a length shorter than that of the large sheet. The large sheet, hereinafter, means a sheet having a length in the conveying direction longer than a distance between the transferring nip the fixing nip. The thin sheet means a sheet, including a regular sheet, having a thickness smaller than that of a thick sheet. More particularly, the thin sheet has a weight lighter than 250 g/m$^2$; the thick sheet has a weight equal to or heavier than 250 g/m$^2$.

Figure 8:
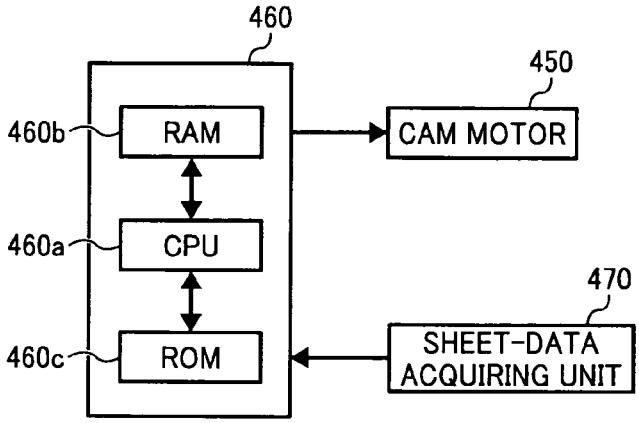
FIG. 8 is a block diagram of a part of an electric circuit included in the copier according to the embodiment.

In the copier according to the embodiment, the eccentric cam 74, a driving-force transmitting system (not shown) that transmits a driving force to the eccentric cam 74, the cam motor 450 that rotates the eccentric cam 74, the system that supports the conveying unit 75 swingably on the driving-roller shaft 77*a*, a later-described control unit 460, and a later-described sheet-data acquiring unit 470 constitute an angle changing unit that changes the angle θ. As shown in FIG. 8, operation of the cam motor 450 is controlled by the control unit 460. The control unit 460 includes a central processing unit (CPU) 460*a*, a random access memory (RAM) 460*b*, and a read only memory (ROM) 460*c*. The control unit 460 is connected to the sheet-data acquiring unit 470 that acquires data about the recording sheet P including thickness and size (hereinafter, "sheet data"). The sheet-data acquiring unit 470 acquires the sheet data from the user using, for example, an operation unit including a touch panel or a numeric keypad (not shown). The sheet-data acquiring unit 470 can receive the sheet data from, for example, a personal computer. Alternatively, the copier can include a thickness detecting unit that detects the thickness of the recording sheet P and a size detecting unit that detects the size of the recording sheet P as the sheet-data acquiring unit. The thickness detecting unit detects the thickness based on, for example, transmittance of the recording sheet P detected by a transmission-type photosensor or an amount of rotation of the conveyer rollers when the recording sheet P is inserted between them. The size detecting unit detects the size of the recording sheet P based on a position of a stopper plate that holds sheets accommodated in a paper cassette or a period during which a photosensor arranged inside a sheet conveying path to detect the recording sheet P is in a detected state. In the copier, the control unit 460 determines the size and the thickness of the recording sheet P using the sheet data received from the sheet-data acquiring unit 470.

The cam motor 450 is a stepper motor. The control unit 460 sends a predetermined number of driving pulses to the cam motor 450 to move the eccentric cam 74 to the position shown in FIG. 5A or the position shown in FIG. 5B. When the mode A is selected, the control unit 460 drives the cam motor 450 in such a manner that the angle θ between the imaginary straight line parallel to the sheet conveying direction in which the conveying unit 75 conveys the recording sheet P and the guiding surface 83*a* of the fixing-unit-entrance guiding plate 83 is set to an angle θ1. Thereby, the conveyance surface of the conveying unit 75 is arranged under the imaginary straight line drawn between the transferring nip and the fixing nip so that a large buffer indicated by a shaded area is secured. The angle θ1 (see FIG. 5A) is smaller than an angle θ2 (see FIG. 5B) that is the largest angle that the angle θ can take. Because the angle θ is equal to the angle θ1 in the mode A, the recording sheet P is conveyed to the fixing nip along a curved path. This makes it possible to prevent a vibration at the transferring nip that occurs when the recording sheet P enters the fixing nip.

It is clear from a comparison between FIGS. 5A and 5B that the slope of the guiding surface 83*a* of the fixing-unit-entrance guiding plate 83 in the mode A is steeper than that in the mode B. Because the slope is set steep when the regular sheet or the thin sheet is used, even if the recording sheet P has a slightly curled edge, a fold or a crease is unlikely to be made.

The mode B is selected if the recording sheet P is a thick, small sheet, such as a postcard, i.e., a sheet having a weight 250 g/m$^2$ and a length short enough that the trailing edge has already passed through the transferring nip when the leading edge comes in contact with the guiding surface 83*a*. If the mode B is selected as shown in FIG. 5B, the control unit 460 rotates the eccentric cam 74 by a half turn from the position corresponding to the mode A. With the rotation of the eccentric cam 74, the conveying unit 75 and the fixing-unit-entrance guiding plate 83 are moved from positions corresponding to the mode A indicated by broken lines to positions corresponding to the mode B indicated by continuous lines. As a result, the angle θ between the conveyance surface of the conveying unit 75 and the guiding surface 83*a* of the fixing-unit-entrance guiding plate 83 increases to the angle θ2. The angle θ2, which is larger than the angle θ1, is selected in the mode B. Because the angle θ is large, the recording sheet P is likely to be in contact with the conveyance surface of the conveying unit 75 and enters the fixing-unit-entrance guiding plate 83 smoothly, which maintains a high smoothness of conveyance.

Figure 9:
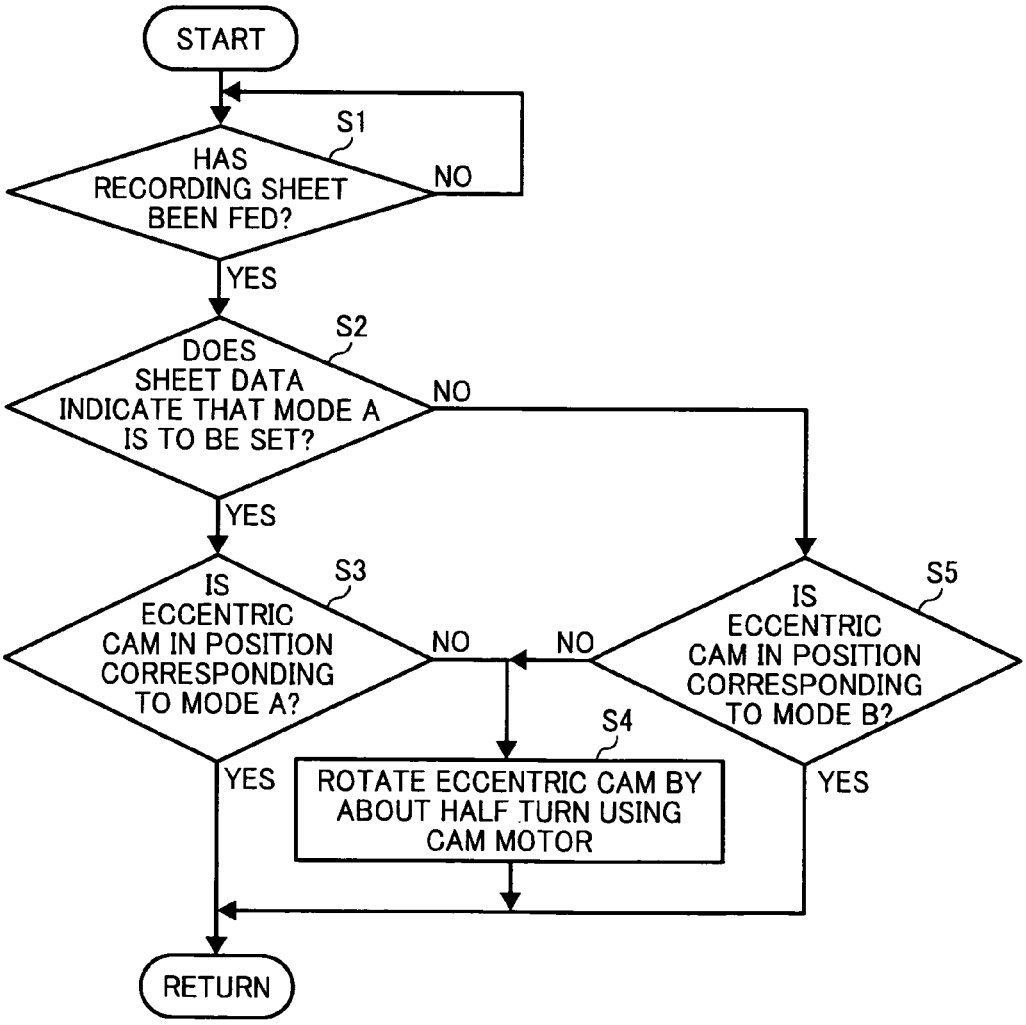
FIG. 9 is a flowchart of a control process performed by a control unit included in the copier.
Figure 10:
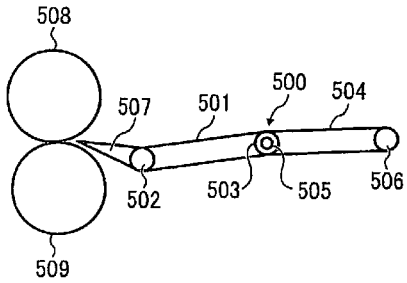
FIG. 10 CONVENTIONAL ART
FIG. 10 is an enlarged schematic diagram of a conveying unit and relevant parts included in an image forming apparatus disclosed in Japanese Patent Application Laid-open No. 2001-240268.
Figure 11:
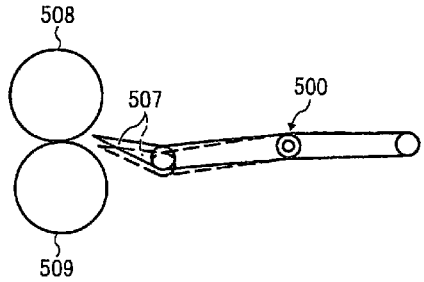
FIG. 11 CONVENTIONAL ART
FIG. 11 is a schematic diagram that depicts an arrangement of the conveying unit shown in FIG. 10 when a large thick sheet is used as the recording sheet.
Figure 12:
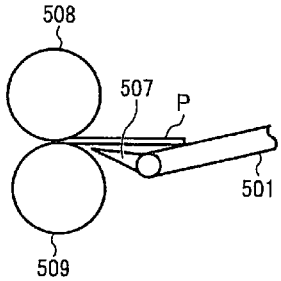
FIG. 12 CONVENTIONAL ART
FIG. 12 is a schematic diagram that depicts an arrangement of the conveying unit shown in FIG. 10 when a postcard is used as the recording sheet.
Figure 13:
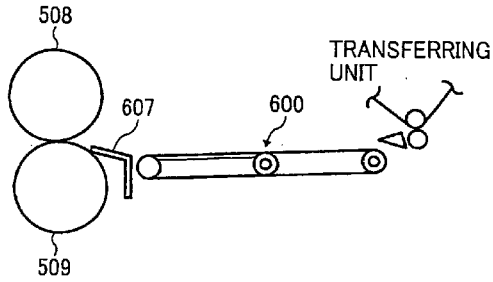
FIG. 13 CONVENTIONAL ART
FIG. 13 is an enlarged schematic diagram of a conveying unit and relevant parts according to an image forming apparatus disclosed in Japanese Patent Application Laid-open No. 2002-2997.
Figure 14:
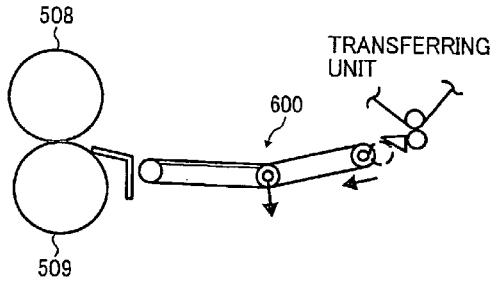
FIG. 14 CONVENTIONAL ART
FIG. 14 is a schematic diagram that depicts an arrangement of the conveying unit when a large thick sheet is used as the recording sheet.
Figure 15:
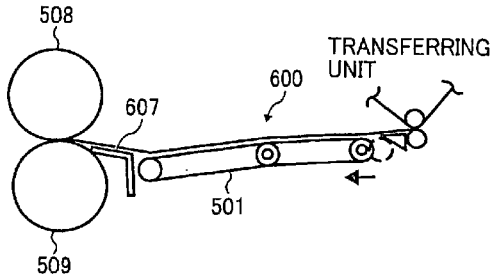
FIG. 15 CONVENTIONAL ART
FIG. 15 is a schematic diagram that depicts an arrangement of the conveying unit when a postcard is used as the recording sheet.

FIG. 9 is a flowchart of a control process performed by the control unit 460. When a print job starts and the recording sheet P is then fed from the paper cassette 201 (Yes at Step S1), the control unit 460 determines whether the mode A is to be set using the sheet data that is received from the sheet-data acquiring unit 470 (Step S2). More particularly, if the recording sheet P has a length in the sheet conveying direction longer than the distance between the transferring nip and the fixing nip or the recording sheet P is the thin sheet having a length shorter than the distance, the mode A is selected. If the mode A is to be set (Yes at Step S2), the control unit 460 determines whether the eccentric cam 74 is in stop at the position shown in FIG. 5A corresponding to the mode A (Step S3). If the eccentric cam 74 is in stop at the position corresponding to the mode A (Yes at Step S3), the control unit 460 maintains the eccentric cam 74 as it is without driving the cam motor 450. If the eccentric cam 74 is the position different from the position corresponding to the mode A (No at Step S3), the control unit 460 drives the cam motor 450 to rotate the eccentric cam 74 about a half turn (Step S4). With this driving, the angle θ is switched from θ2 to θ1.

If the mode A is not to be set (No at Step S2), the control unit 460 determines whether the eccentric cam 74 is in stop at the position shown in FIG. 5B corresponding to the mode B (Step S5). If the eccentric cam 74 is in stop at the position corresponding to the mode B (Yes at Step S5), the control unit 460 maintains the eccentric cam 74 as it is without driving the cam motor 450. If the eccentric cam 74 is the position different from the position corresponding to the mode B (No at Step S5), the control unit 460 drives the cam motor 450 to rotate the eccentric cam 74 about a half turn (Step S4). With this driving, the angle θ is switched from θ1 to θ2.

Figure 6A:
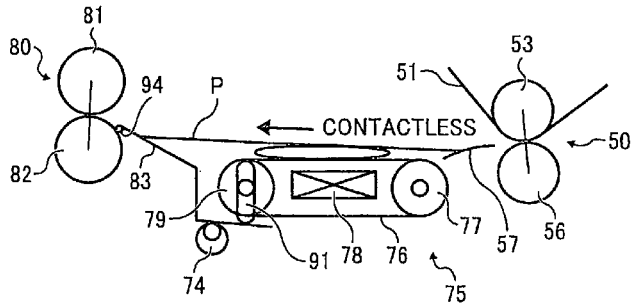
FIG. 6A is a schematic diagram that depicts an arrangement of a recording sheet and a conveyance surface of the conveying unit where the recording sheet forms a "bridge"
Figure 6B:
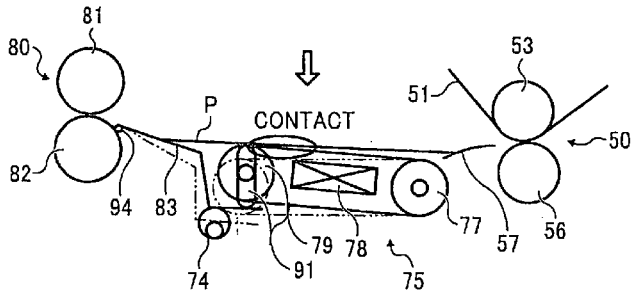
FIG. 6B is a schematic diagram that depicts an arrangement of the recording sheet and the conveyance surface of the conveying unit where the recording sheet is conveyed smoothly.
Figure 7A:
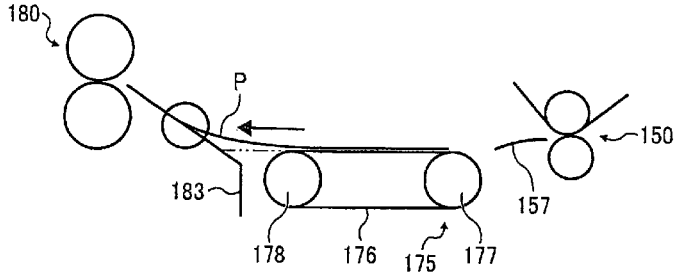
FIG. 7A CONVENTIONAL ART
FIG. 7A is a schematic diagram of a conventional conveying unit and a conventional fixing-unit-entrance guiding plate.
Figure 7B:
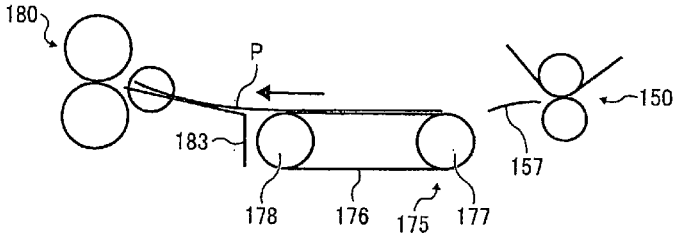
FIG. 7B CONVENTIONAL ART
FIG. 7B is a schematic diagram of the conventional conveying unit and the conventional fixing-unit-entrance guiding plate when the conventional conveying unit conveys a sheet having a curled edge as the recording sheet.

FIGS. 6A and 6B are schematic diagrams that explain how the recording sheet P is in contact with the conveyance surface of the conveying unit 75. As shown in FIG. 6A, if a small sheet having a length in the sheet conveying direction shorter than the distance between the transferring nip and the fixing nip (i.e., short enough that the trailing edge has already passed through the transferring nip when the leading edge comes in contact with the guiding surface 83*a*) is conveyed as the recording sheet P in the mode A, the small sheet is conveyed by the force produced only by the conveying unit 75. Because the toner image that is formed on the recording sheet P is unfixed when the recording sheet P is being conveyed by the conveying unit 75, it is preferable to hold the recording sheet P using a nip, i.e., a grip for the stable conveyance. If the recording sheet P is, specifically, extremely thick, the recording sheet P may form a "bridge" between the secondary-transfer-exit guiding plate 57 and the fixing-unit-entrance guiding plate 83, without bending downward along the conveyance surface of the conveying unit 75. In some cases, a paper jam occurs because there is no contact between the recording sheet P and the conveyance surface of the conveying unit 75 or because there is not enough force to convey the recording sheet P up to and along the fixing-unit-entrance guiding plate 83. To solve the problem, if the recording sheet P is the thick small sheet having a weight 250 g/m$^2$ or heavier and a length short enough that the trailing edge has already passed through the transferring nip when the leading edge comes into contact with the guiding surface 83*a*, the mode B is selected. In the mode B, the conveying unit 75 and the fixing-unit-entrance guiding plate 83 are moved to the positions indicated by the broken lines shown in FIG. 6B. With this arrangement, the recording sheet P is likely to be in contact with the conveyance surface of the conveying unit 75 and enters the fixing-unit-entrance guiding plate 83 smoothly, which maintains a high smoothness of conveyance.

To explain it in more detail, as shown in FIG. 6B, as the angle between the imaginary straight line drawn from the edge of the conveying unit 75 parallel to the sheet conveying direction and the guiding surface 83*a* increases from the angle shown in FIG. 6A, a turning angle that the leading edge of the recording sheet P turns after the recording sheet P hits the guiding surface 83*a* decreases. As the turning angle decreases, the recording sheet P can enter the guiding surface 83*a* by less force. Therefore, the recording sheet P is smoothly conveyed by the force produced only by the conveying belt 76. This maintains a high smoothness of conveyance.

Referring back to FIGS. 5A and 5B, a first end of the fixing-unit-entrance guiding plate 83 that is closer to the fixing unit 80 is supported rotatably by a supporting unit (not shown). With this configuration, the fixing-unit-entrance guiding plate 83 can swing about the first end that functions as the fulcrum. The driving roller 77 can swing about the driving-roller shaft 77*a* that is arranged near a second end closer to the transferring unit 50 in the sheet conveying direction. The driving-roller shaft 77*a* functions as the fulcrum. In the copier according to the embodiment, the fixing-unit-entrance guiding plate 83 and the conveying unit 75 are arranged so that a third end of the fixing-unit-entrance guiding plate 83 opposite to the first end and a fourth end of the conveying unit 75 opposite to the second end are overlapped to each other. In the examples shown in FIGS. 5A and 5B, the third end is under the fourth end. However, the third end can be above the fourth end.

The cam surface of the eccentric cam 74 comes in contact with the third end of the fixing-unit-entrance guiding plate 83. The fixing-unit-entrance guiding plate 83, which is in contact with the cam surface of the eccentric cam 74, swings on the first end closer to the fixing unit 80 as the eccentric cam 74 rotates. The movement of the third end associated with the rotation of the eccentric cam 74 is transmitted to the conveying unit 75 via the third end. In this manner, the movement of the fixing-unit-entrance guiding plate 83 associated with the rotation of the eccentric cam 74 is linked to the movement of the conveying unit 75. With this configuration, the angle changing unit including the eccentric cam 74 changes both the angle θ and the slope of the guiding surface 83*a* of the fixing-unit-entrance guiding plate 83.

When the third end of the fixing-unit-entrance guiding plate 83 is moved up by the rotation of the eccentric cam 74, the fourth end of the conveying unit 75 is also moved up in the associated manner. On the other hand, when the third end of the fixing-unit-entrance guiding plate 83 is moved down by the rotation of the eccentric cam 74, the fourth end of the conveying unit 75 is also moved down in the associated manner. With the associated movement between the fixing-unit-entrance guiding plate 83 and the conveying unit 75, when it is switched from the mode B shown in FIG. 6B to the mode A shown in FIG. 6A, the slope of the guiding surface 83*a* becomes gentler. The change of the slope of the guiding surface 83*a* increases the angle θ more. Therefore, the angle θ increases more with a small movement of the eccentric cam 74 as compared with the case where the fixing-unit-entrance guiding plate 83 is fixed. This reduces a necessary space.

Because the fixing-unit-entrance guiding plate 83 can swing about the first end closer to the fixing unit 80, the fixing-unit-entrance guiding plate 83 guides the recording sheet P always toward the fixed point, i.e., the entrance of the fixing nip, regardless of the swing position. It means that, in contrast to the conventional image forming apparatus disclosed in Japanese Patent Application Laid-open No. 2001-240268, the fixing-unit-entrance guiding plate 83 does not guide the recording sheet P toward the surface of the heat roller 81 that is located in front of the entrance of the fixing nip, which prevents formation of a distorted image.

In the copier according to the embodiment, if the recording sheet P has a length longer than the distance between the exit of the transferring nip and the entrance of the fixing nip, the control unit, which functions as the angle changing unit, sets the angle θ to θ1 that is smaller than at least another settable value. Because the recording sheet P goes along a curved path from the transferring nip to the fixing nip, a vibration at the transferring nip that occurs when the recording sheet P enters the fixing nip can be prevented.

Furthermore, the fixing-unit-entrance guiding plate 83 can swing about the first end closer to the fixing unit in the sheet conveying direction. The angle changing unit including the eccentric cam 74 sets the angle θ appropriately by swinging the fixing-unit-entrance guiding plate 83. Therefore, the slope of the guiding surface 83*a* of the fixing-unit-entrance guiding plate 83 is changed associated with a change of the angle θ.

Moreover, if the recording sheet P is a thin sheet, the control unit moves the fixing-unit-entrance guiding plate 83 in such a manner that the slope of the guiding surface 83*a* is set steeper than a slope of the guiding surface 83*a* to be set when the recording medium is a thick small sheet. With this configuration, even if the recording sheet P is curled, a fold or a crease is unlikely to be made.

Furthermore, the conveying unit 75 can swing about the second end closer to the transferring unit in the sheet conveying direction. The angle changing unit including the eccentric cam 74 sets the angle θ appropriately by swinging the conveying unit 75. Therefore, an angle with respect to the sheet conveying direction from the conveying unit 75 is changed associated with a change of the angle θ.

Moreover, the fixing-unit-entrance guiding plate 83 can swing about the first end closer to the fixing unit in the sheet conveying direction. The conveying unit 75 can swing about the second end closer to the transferring unit in the sheet conveying direction. The angle changing unit including the eccentric cam 74 sets the angle θ appropriately by swinging the conveying unit 75 and the fixing-unit-entrance guiding plate 83. Therefore, both the slope of the guiding surface 83*a* of the fixing-unit-entrance guiding plate 83 and the angle with respect to the sheet conveying direction from the conveying unit 75 are changed associated with a change of the angle θ.

Furthermore, the third end of the fixing-unit-entrance guiding plate 83 closer to the conveying unit 75 and the fourth end of the conveying unit 75 closer to the fixing-unit-entrance guiding plate 83 are overlapped to each other. When the third end is moved by the rotation of the eccentric cam 74, because the third end and the fourth end are overlapped to each other, the movement of the third end is transmitted to the fourth end. In other words, the movement of fourth end is linked to the movement of the third end. Therefore, both the fixing-unit-entrance guiding plate 83 and the conveying unit 75 are moved by the movement of the movable eccentric cam 74.

Moreover, in the angle changing unit, the eccentric cam 74 moves the fixing-unit-entrance guiding plate 83 at the overlapped section. Therefore, the eccentric cam 74 moves both the fixing-unit-entrance guiding plate 83 and the conveying unit 75.

Furthermore, the conveying unit 75 includes the conveying belt 76 that is supported by the driving roller 77 and the driven roller 79. The conveying belt 76, which is an endless belt, conveys the recording sheet P. The conveying unit 75 is arranged between the transferring unit 50 and the fixing unit 80 with the driving roller 77 being closer to the transferring unit 50 and the driven roller 79 being closer to the fixing unit 80. Because heat generated by the fixing unit 80 is barely transmitted to the driving roller 77, which is closer to the transferring unit 50, a change in the diameter of the driving roller 77 caused by heat is suppressed. Therefore, a change in speed of the conveying belt 76 is also suppressed.

Moreover, the conveying belt 76 has a plurality of pores. There is the sheet-suction fan 78 inside the loop of the conveying belt 76. The sheet-suction fan 78 generates airflow through the pores so that the recording sheet P adheres to the surface of the conveying belt 76. Therefore, the smoothness of conveyance by the conveying belt 76 is improved.

According to one aspect of the present invention, a conveying unit causes a recording medium to abut against a guiding surface of a guiding member and then conveys the recording medium to a fixing nip in a fixing unit with a leading edge of the recording medium being bent. Because the fixing unit receives the recording medium with the leading edge being bent, the force that is applied by the fixing nip to the leading edge to convey the recording medium is not significantly transmitted to a transferring nip in a transferring unit between which the trailing edge of the recording medium is inserted. This prevents the formation of a distorted image at the transferring nip. This means that the same effect is obtained instead of usage of a complicated conveying unit that is designed so that both sections can swing about the fulcrum at or close to the center or a process of causing the recording medium to come into contact with a part of a heating member in front of the entrance of the fixing nip.

Furthermore, according to another aspect of the present invention, an angle between a conveyance surface of the conveying unit and the guiding surface of the guiding member is set appropriately. If the recording medium is a thick small sheet (small enough that the trailing edge has passed through the transferring nip when the leading edge comes in contact with the guiding member), the angle is set larger than the angle to be set when the recording medium is a thick large sheet. The thick small sheet is thus conveyed with the entire surface from the leading edge to the trailing edge being almost straight. Therefore, because the thick small sheet can be conveyed by less force, occurrence of paper jams is reduced.

Moreover, according to still another aspect of the present invention, a stable conveyability can be obtained regardless of the type of recording media while reducing the formation of distorted images or paper jams with a simple structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a transferring unit that transfers a toner image from an image carrier to a recording medium;

a fixing unit that fixes the toner image transferred onto the recording medium;

a conveying unit that conveys the recording medium from the transferring unit to the fixing unit along a conveyance surface, the conveying unit rotates on a first pivot positioned upstream in a sheet conveying direction;

a guiding member that is separate from the conveying unit, the guiding member receives the recording medium from the conveying unit and guides the recording medium to a fixing nip of the fixing unit along a guiding surface, and the guiding member rotates on a second pivot positioned downstream in the sheet conveying direction; and an angle changing unit that changes an angle between the conveyance surface and the guiding surface in the sheet conveying direction according to a type of the recording medium, wherein in a case where the recording medium is thick with a length such that a trailing edge of the recording medium passes through the transferring unit when a leading edge of the recording medium comes into contact with the guiding surface, the angle changing unit changes the angle to a first angle which is larger than a second angle to be set when the recording medium is thinner than the recording medium that is thick, and wherein a gap is formed between the transferring unit and the conveying unit, the gap being fixed with respect to the transferring unit and the conveying unit.

2. The image forming apparatus according to claim 1, wherein, in a case where the recording medium has a length in the sheet conveying direction longer than a distance between the transferring nip and the fixing nip, the angle changing unit changed the angle to a third angle that is smaller than the first angle.

3. The image forming apparatus according to claim 1, wherein the guiding member is swingable around a fulcrum that is at or near a first end of the guiding member that is arranged closer to the fixing unit in the sheet conveying direction, and the angle changing unit changes the angle by swinging the guiding member.

4. The image forming apparatus according to claim 1, wherein the conveying unit is swingable around a fulcrum that is at or near a second end of the conveying unit that is arranged closer to the transferring unit in the sheet conveying direction, and the angle changing unit changes the angle by swinging the conveying unit.

5. The image forming apparatus according to claim 1, wherein the guiding member is swingable around a fulcrum that is at or near a first end of the guiding member that is arranged closer to the fixing unit in the sheet conveying direction, the conveying unit is swingable around a fulcrum that is at or near a second end of the conveying unit that is arranged closer to the transferring unit in the sheet conveying direction, and the angle changing unit changes the angle by swinging the guiding member and the conveying unit.

6. The image forming apparatus according to claim 5, wherein a third end of the guiding member that is arranged closer to the conveying unit and a fourth end of the conveying unit that is arranged closer to the guiding member are overlapped to each other, thereby forming an overlapped section, and the guiding member and the conveying unit moves together by an interaction of a movement applied by the angle changing unit to either one of which via the overlapped section.

7. The image forming apparatus according to claim 6, wherein the angle changing unit applies the movement to either one of the guiding member and the conveying unit using an eccentric cam at the overlapped section.

8. The image forming apparatus according to claim 1, further comprising a sheet-data acquiring unit that acquires sheet data including size and thickness of the recording medium, wherein the angle changing unit changes the angle based on the sheet data.

9. The image forming apparatus according to claim 1, wherein the conveying unit includes a belt that rotates endlessly to convey the recording medium and is supported by a driving roller and a driven roller, and the conveying unit is arranged between the transferring unit and the fixing unit with the driving roller being closer to the transferring unit and the driven roller being closer to the fixing unit.

10. The image forming apparatus according to claim 9, wherein the belt has a plurality of pores, and the image forming apparatus further comprises a suction unit that is arranged inside of a loop of the belt and generates an airflow through the pores so that the recording medium adheres onto a surface of the belt.

11. The image forming apparatus according to claim 1, wherein the angle is defined by a position at which a supporting member of the conveying unit comes into slidably contact with a surface of the guiding member.

12. The image forming apparatus according to claim 1, wherein the guiding member rotates about a shaft that is on a side downstream in the sheet conveying direction.

13. The image forming apparatus according to claim 1, wherein a gap is formed between the fixing unit and the conveying unit, the gap being variable with respect to the fixing unit and the conveying unit.

14. The image forming apparatus according to claim 1, further comprising a driving unit, wherein the driving unit is near an end of the conveying unit farther from the first pivot and near an end of the guiding member farther from the second pivot.

15. An image forming apparatus, comprising:

a transferring unit that transfers a toner image from an image carrier to a recording medium;

a fixing unit that fixes the toner image transferred onto the recording medium;

a conveying unit that conveys the recording medium from the transferring unit to the fixing unit along a conveyance surface, the conveying unit rotates on a first pivot positioned upstream in a sheet conveying direction;

a guiding member that receives the recording medium from the conveying unit and guides the recording medium to a fixing nip of the fixing unit along a guiding surface, the guiding member rotates on a second pivot positioned downstream in the sheet conveying direction; and an angle changing unit that changes an angle between the conveyance surface and the guiding surface in the sheet conveying direction, wherein a gap is formed between the transferring unit and the conveying unit, the gap being fixed with respect to the transferring unit and the conveying unit.

* * * * *